US008539717B2

(12) United States Patent
Speyer et al.

(10) Patent No.: US 8,539,717 B2
(45) **Date of Patent: *Sep. 24, 2013**

(54) ELECTRONIC CONTROL FOR DOOR/WINDOW

(75) Inventors: W. Kip Speyer, Boca Raton, FL (US); Jonathan D. Thielmann, Delray Beach, FL (US); Mark O. Gerwig, Pembroke Pines, FL (US)

(73) Assignee: Secura-Seal Technologies LLC, Bensalem, PA (US)

( * ) Notice: Subject to any disclaimer, the term of this patent is extended or adjusted under 35 U.S.C. 154(b) by 487 days.

This patent is subject to a terminal disclaimer.

(21) Appl. No.: 12/021,171

(22) Filed: Jan. 28, 2008

(65) Prior Publication Data

US 2008/0156052 A1 Jul. 3, 2008

Related U.S. Application Data

(63) Continuation-in-part of application No. 11/756,948, filed on Jun. 1, 2007, which is a continuation-in-part of application No. 11/425,386, filed on Jun. 20, 2006, now Pat. No. 7,627,987, application No. 12/021,171, which is a continuation-in-part of application No. 11/846,139, filed on Aug. 28, 2007, which is a continuation-in-part of application No. 11/322,952, filed on Dec. 30, 2005, now Pat. No. 7,685,775, application No. 12/021,171, which is a continuation-in-part of application No. 11/756,957, filed on Jun. 1, 2007, which is a continuation-in-part of application No. 11/425,377, filed on Jun. 20, 2006, now Pat. No. 7,624,539.

(60) Provisional application No. 61/018,190, filed on Dec. 31, 2007.

(51) Int. Cl.
*E06B 7/28* (2006.01)

(52) U.S. Cl.
USPC ..... 49/319; 49/25; 49/318; 49/316

(58) Field of Classification Search
USPC ..... 49/25, 303, 316, 317, 318, 319, 320, 49/321
See application file for complete search history.

(56) References Cited

U.S. PATENT DOCUMENTS 19,217 A 1/1858 Tinney
724,139 A 3/1903 Smith (Continued)

OTHER PUBLICATIONS

Dictionary.com, "Active," retrieved online at: http://dictionary.reference.com/browse/active (2010).

(Continued)

*Primary Examiner* — Jerry Redman
(74) *Attorney, Agent, or Firm* — Nelson Mullins Riley & Scarborough LLP; Anthony A. Laurentano

(57) ABSTRACT

A combined active sealing system for connecting a panel to a frame of a door/window comprises a plurality of active sealing systems, a seal activation system, and an electronic control system. Each of the plurality of active sealing systems includes an anchor for engaging one of the panel and the frame, and an actuator connected to the anchor and for driving the anchor. In a closed position of the panel relative to the frame, the anchor is movable between a locked position and an unlocked position. The seal activation system is connected to at least one of the actuators of the plurality of active sealing systems. The electronic control system controls the seal activation system.

15 Claims, 14 Drawing Sheets

(56) References Cited

U.S. PATENT DOCUMENTS 946,305 A 1/1910 Abbott
982,828 A 1/1911 Kelly
1,009,978 A 11/1911 Knappe
1,021,862 A 4/1912 Culver
1,170,101 A 2/1916 Pullets
1,178,775 A 4/1916 Albright
1,345,967 A 7/1920 Smelser
1,468,958 A 9/1923 Champion
1,489,018 A 4/1924 Shultz
1,675,230 A 6/1928 Snyder
1,715,188 A 5/1929 Bullock
1,797,839 A 3/1931 Ramsay
1,974,269 A 9/1934 Gonder
1,977,726 A 10/1934 Jacobson
1,995,939 A 3/1935 Osten
2,207,065 A * 7/1940 McCormick ..... 49/318
2,248,719 A 7/1941 Owen
2,268,114 A 12/1941 Foster
2,541,421 A 2/1951 Hunter
2,552,369 A 5/1951 Currie
2,593,093 A 4/1952 Bjork
2,628,678 A 2/1953 Webster
2,719,342 A 10/1955 Hunt
2,753,020 A 7/1956 Ware
2,766,860 A 10/1956 Travis
2,805,451 A 9/1957 Evans
2,837,151 A 6/1958 Stroup
2,862,256 A 12/1958 Stroup
2,862,262 A 12/1958 Shea
2,928,144 A 3/1960 Persson
3,004,309 A 10/1961 Karodi
3,054,152 A 9/1962 Trammell
3,059,287 A 10/1962 Baruch
3,070,856 A 1/1963 Minick
3,077,644 A 2/1963 Kesling
3,098,519 A 7/1963 Myers
3,111,727 A 11/1963 Gerecke
3,126,051 A 3/1964 Sussin
3,163,891 A 1/1965 Seliger
3,184,806 A 5/1965 Bragman
3,252,255 A 5/1966 Marpe
3,289,377 A 12/1966 Hetman
3,295,257 A 1/1967 Douglass
3,335,524 A 8/1967 Carson
3,374,821 A 3/1968 White
3,383,801 A 5/1968 Dallaire
3,466,801 A 9/1969 Bohn
3,512,303 A 5/1970 Wright
3,590,530 A 7/1971 Duguay
3,590,531 A 7/1971 Childs
3,660,936 A 5/1972 Bryson
3,660,940 A 5/1972 Tavano
3,816,966 A 6/1974 Sause, Jr.
3,818,636 A 6/1974 Calais et al.
3,821,884 A 7/1974 Walsh
3,848,908 A 11/1974 Rich
3,857,199 A 12/1974 Frach et al.
3,910,155 A 10/1975 Wilson
3,959,927 A 6/1976 Good
4,018,022 A 4/1977 Fink
4,027,431 A 6/1977 Rackard
4,064,651 A 12/1977 Homs
4,128,967 A 12/1978 Kirsch
4,170,846 A 10/1979 Dumenil et al.
4,307,542 A 12/1981 Lense
4,317,312 A 3/1982 Heideman
4,322,914 A 4/1982 McGaughey
4,392,329 A 7/1983 Suzuki
4,413,446 A 11/1983 Dittrich
4,453,346 A 6/1984 Powell et al.
4,479,330 A 10/1984 Muller
4,496,942 A * 1/1985 Matsuoka ..... 340/825.57
4,535,563 A 8/1985 Mesnel
4,614,060 A 9/1986 Dumenil et al.
4,656,779 A 4/1987 Fedeli
4,656,799 A 4/1987 Maryon
4,716,693 A 1/1988 Webster
4,765,105 A 8/1988 Tissington et al.
4,768,316 A 9/1988 Haas
4,831,509 A * 5/1989 Jones et al. ..... 700/90
4,837,560 A * 6/1989 Newberry ..... 340/578
4,870,909 A 10/1989 Richter
4,936,049 A 6/1990 Hansen
5,007,202 A 4/1991 Guillon
5,020,292 A 6/1991 Strom et al.
5,029,911 A 7/1991 Daniels
5,030,488 A 7/1991 Sobolev
5,187,867 A 2/1993 Rawlings
5,293,726 A 3/1994 Schick
5,327,684 A 7/1994 Herbst
5,339,881 A 8/1994 Owens
5,349,782 A 9/1994 Yulkowski
5,379,518 A 1/1995 Hopper
5,446,997 A 9/1995 Simonton
5,467,559 A 11/1995 Owens
5,479,151 A * 12/1995 Lavelle et al. ..... 340/542
5,511,833 A 4/1996 Tashman et al.
5,521,585 A * 5/1996 Hamilton ..... 340/628
5,522,180 A 6/1996 Adler et al.
5,522,195 A 6/1996 Bargen
5,569,878 A 10/1996 Zielinski
5,584,142 A 12/1996 Spiess
5,605,013 A * 2/1997 Hogston ..... 49/31
5,638,639 A 6/1997 Goodman et al.
5,784,834 A 7/1998 Stutzman
5,786,547 A 7/1998 Zielinski
5,870,859 A 2/1999 Kitada
5,870,869 A 2/1999 Schrader
5,964,060 A * 10/1999 Furlong ..... 49/320
6,041,552 A 3/2000 Lindahl
6,057,658 A * 5/2000 Kovach et al. ..... 318/16
6,082,047 A 7/2000 Comaglio et al.
6,105,313 A 8/2000 Holloway et al.
6,112,466 A 9/2000 Smith et al.
6,112,467 A 9/2000 Bark et al.
6,112,496 A 9/2000 Hugus et al.
6,170,195 B1 1/2001 Lim
6,173,533 B1 1/2001 Cittadini et al.
6,181,089 B1 * 1/2001 Kovach et al. ..... 318/16
6,202,353 B1 3/2001 Giacomelli
6,218,939 B1 * 4/2001 Peper ..... 340/545.1
6,243,999 B1 6/2001 Silverman
6,289,643 B1 9/2001 Bonar
6,318,037 B1 11/2001 Hansen
6,442,899 B1 9/2002 Gledhill
6,490,832 B1 12/2002 Fischbach et al.
D470,252 S 2/2003 Castrey
6,546,682 B1 4/2003 DeBlock et al.
6,553,735 B1 4/2003 Wang Chen
6,568,131 B1 * 5/2003 Milano, Jr. ..... 49/82.1
6,619,005 B1 9/2003 Chen
6,644,884 B2 11/2003 Gledhill
6,651,389 B2 11/2003 Minter et al.
6,772,818 B2 8/2004 Whitley et al.
6,786,005 B1 * 9/2004 Williams ..... 49/141
6,871,902 B2 3/2005 Carson et al.
6,973,753 B2 12/2005 Liebscher
7,010,888 B2 3/2006 Tumlin et al.
7,124,538 B1 10/2006 Kline
7,145,436 B2 * 12/2006 Ichikawa et al. ..... 340/5.72
7,185,468 B2 3/2007 Clark et al.
7,487,616 B2 2/2009 Deaver
7,566,035 B2 7/2009 Bonshor
7,624,539 B2 12/2009 Speyer et al.
7,627,987 B2 12/2009 Thielmann et al.
7,665,245 B2 2/2010 Speyer et al.
7,685,774 B2 3/2010 Thielmann
7,685,775 B2 3/2010 Speyer et al.
7,685,776 B2 3/2010 Speyer et al.
7,707,773 B2 5/2010 Thielmann et al.
7,719,213 B2 * 5/2010 Herman et al. ..... 318/16
8,074,400 B2 12/2011 Speyer et al.

| | | | | |
|---|---|---|---|---|
| 2003/0033786 | A1 | 2/2003 | Yulkowski | |
| 2004/0068935 | A1* | 4/2004 | Ichikawa et al. | 49/25 |
| 2005/0097842 | A1 | 5/2005 | Arcamonte et al. | |
| 2005/0102908 | A1 | 5/2005 | Martin | |
| 2006/0207199 | A1 | 9/2006 | Darnell | |
| 2007/0289221 | A1 | 12/2007 | Speyer et al. | |
| 2009/0151259 | A1 | 6/2009 | Speyer et al. | |
| 2009/0165415 | A1 | 7/2009 | Salerno | |
| 2009/0165423 | A1 | 7/2009 | Salerno | |
| 2010/0077665 | A1 | 4/2010 | Speyer et al. | |

OTHER PUBLICATIONS

Patio Life—Operation, retrieved online at: http://www.rotohardware.com/Products/Patio%20Life/PL-Operation.htm (2006).

International Search Report for Application No. PCT/US2010/029383, dated May 25, 2010.

International Search Report for Application No. PCT/US2010/029206, dated Jun. 2, 2010.

* cited by examiner

ELECTRONIC CONTROL FOR DOOR/WINDOW

CROSS-REFERENCE TO RELATED APPLICATIONS

This application is a Continuation-In-Part of U.S. patent application Ser. No. 11/756,948, filed on Jun. 1, 2007, which is a Continuation-In-Part of U.S. Pat. No. 7,627,987, filed on Jun. 20, 2006 and issued on Dec. 8, 2009, all of which are incorporate herein by reference in their entirety. This application is also a Continuation-In-Part of U.S. patent application Ser. No. 11/846,139, filed on Aug. 28, 2007, which application is a Continuation-In-Part of U.S. Pat. No. 7,685,775, filed on Dec. 30, 2005and issued on Mar. 30, 2010, and a Continuation-In-Part of U.S. patent application Ser. No. 11/756,957, filed on Jun. 1, 2007, which is a Continuation-In-Part of U.S. Pat. No. 7,624,539, filed on Jun. 20, 2006, and issued on Dec. 1, 2009, all of which are incorporated herein by reference in their entirety. This application claims the benefit of U.S. patent application Ser. No. 61/018,190, filed on Dec. 31, 2007, which is incorporated herein in its entirety.

BACKGROUND OF THE INVENTION

1. Field of the Invention

The disclosure relates generally to sealing systems for use with panels, such as a door or a window, within a frame and, more specifically, to an electronic control for use with a sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. Alternatively, the one or more panel may slide relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side of the panel.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

Another issue associated with the movement of one or more panels relative to the frame is structural integrity and/or security of the panels relative to the frame. While in certain circumstances, allowing the panel to move relative to the frame is desirable, in other circumstances, not allowing the panel to move relative to the frame is desirable for the purpose of preventing undesired access through the panel. Means for providing these separate functionalities, however, can be incompatible with one another, and the means employed to provide both functions often involve tradeoffs that reduce the effectiveness of both functions.

There is, therefore, also a need for a sealing system that effectively allows both a panel to move relative to the frame and also to selectively prevent movement of the panel relative to the frame. There is also a need for a sealing system that can be employed between a frame and panel that prevents the transfer from one side of the panel to the other side of the panel such environmental effects as noise, weather, water, heat/cold, and insects.

BRIEF SUMMARY OF THE INVENTION

Embodiments of the invention address deficiencies of the art with respect to effectively creating a seal between a panel and a frame. In this regard, a combined active sealing system for connecting a panel to a frame of a door/window comprises a plurality of active sealing systems, a seal activation system, and an electronic control system. Each of the plurality of active sealing systems includes an anchor for engaging one of the panel and the frame, and an actuator connected to anchor and for driving the anchor. In a closed position of the panel relative to the frame, the anchor is movable between a locked position and an unlocked position. The seal activation system is connected to at least one of the actuators of the plurality of active sealing systems. The electronic control system controls the seal activation system.

In certain aspects, the electronic control system includes a control module, an unlocking actuator, and a locking actuator. The control module controls activation of the unlocking actuator and the locking actuator. A wireless control device wirelessly connected to the control module, and a wired control device having a wired connection to the control module. A battery supplies power to the electronic control system, and the battery is positioned within the frame. A low-battery indicator is also provided. A power supply is electrically connected to a building in which the door/window is installed, and the power supply is adapted to recharge the battery. A security device controls access by a user to the control module. The unlocking actuator can be the locking actuator, and the locking actuator is connected to the seal activation system. Also included is a panel closed limit switch, a lock limit switch, and an unlock limit switch.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
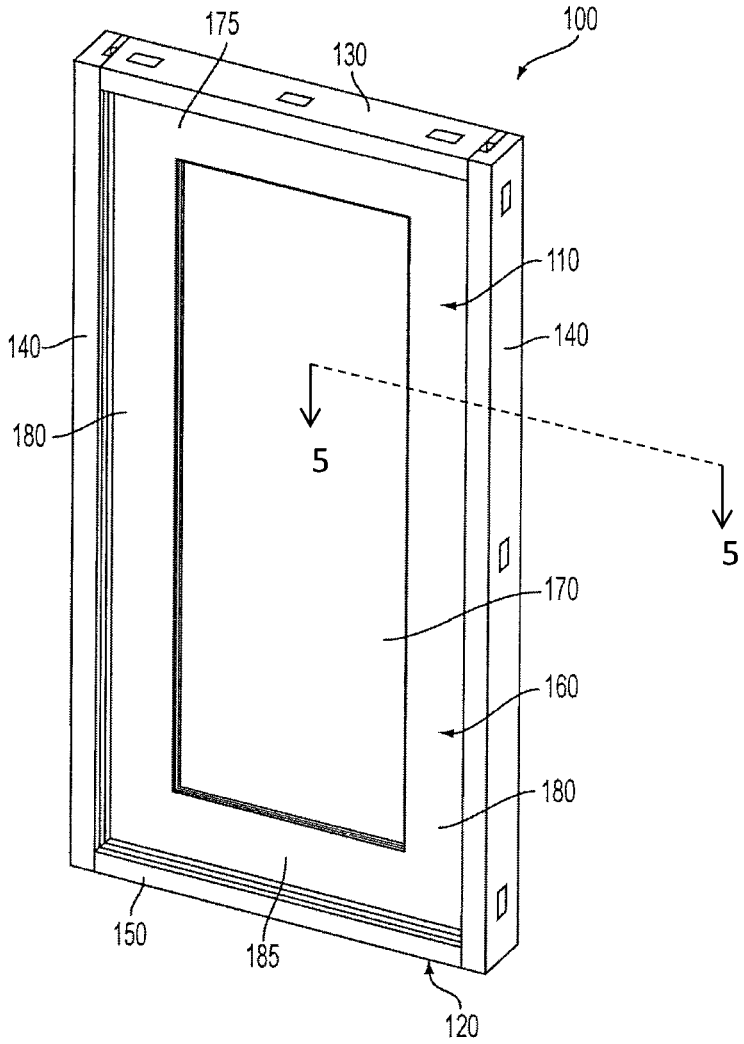
FIG. 1 is a perspective view of a door/window system in a closed position in accordance with the inventive arrangements.
Figure 2C:
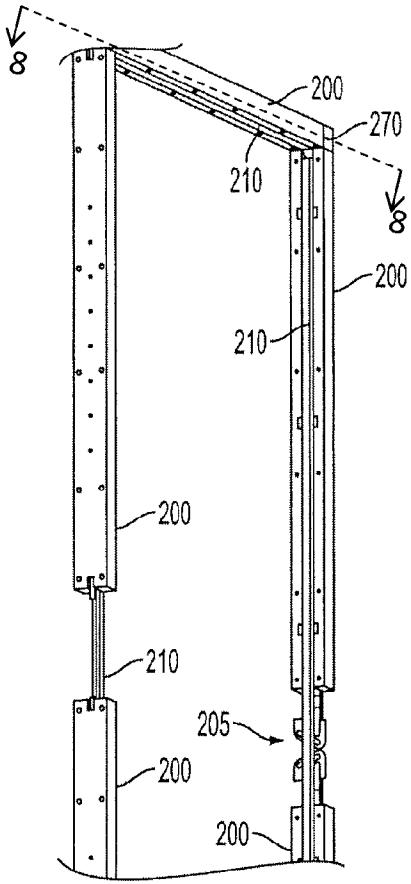
FIGS. 2A-2C are partial, perspective views of multiple sealing system modules in accordance with the inventive arrangements, respectively, in unlocked, partially engaged, and locked configurations.
Figure 2B:
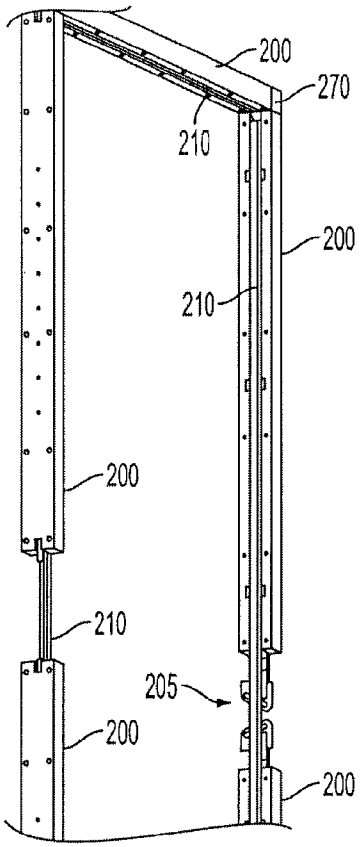
Figure 2A:
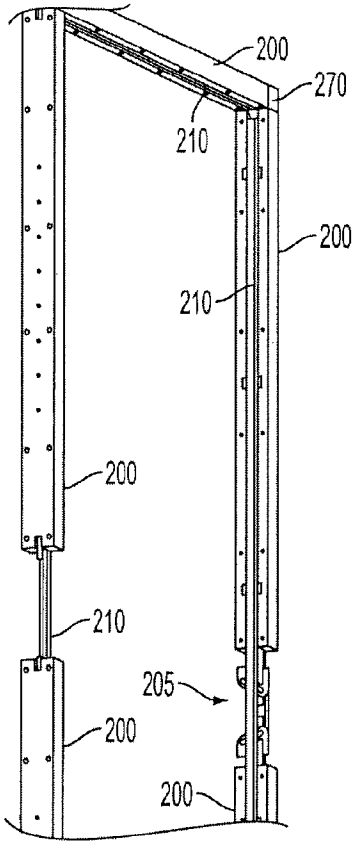

FIG. 1 illustrates an exemplar door/window system 100 for use with the combination active sealing system 200 and seal activation system 205. The combination active sealing system 200 and seal activation system 205 can be used with many types of doors and/or windows, and the combination active sealing system 200 and seal activation system 205 is not limited to the particular door/window system 100 illustrated. For example, the combination active sealing system 200 and seal activation system 205 may be used with pocket doors, sliding doors, French doors, entry doors, garage doors, sliding windows, single-hung windows, double-hung windows, casement windows, and awning windows. The door/window system 100 includes at least one panel 110 connected to a stationary frame 120. Although not limited in this manner, the panel 110 may pivot relative to the frame 120.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

The panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185.

The active sealing system 200 (see FIGS. 2A-2C, 4A-4C, 8A-8C) may be used with each of the members 175, 180, 185 of the sash 160 to form a seal between each pair of adjacent surfaces of the sash 160 of the panel 110 and the frame 120. In this manner, each of the separate sides of the panel 110 may employ the active sealing system 200. As will be described in more detail below, not only does the active sealing system 200 provide at least one seal between adjacent members of sash 160 and frame 120, each of the active sealing systems 200 may be configured to prevent the movement of the panel 110 relative to the frame 120. In so doing, the active sealing systems 200 can act as a lock and/or security device that prevents the forced opening of the panel 110 relative to the frame 120. Many types of active sealing systems 200 so capable are known in the art, and the present door/window system 100 is not limited as to a particular type of active sealing system 200.

Additionally, although the present door/window system 100 is described herein with particular types of active sealing systems 200 being positioned in particular locations, the door/window system 100 is not limited as to a particular type of active sealing system 200 or a particular location of the active sealing system 200. For example, an active sealing system 200 may be positioned within the frame 120 and/or the sash 160. However, in certain aspects of the door/window system 100, the active sealing systems 200 are positioned within the frame 120.

To prevent the forced opening of the panel 110, the active sealing systems 200 are not limited as to a percentage of coverage between particular members of the frame 120 and/or panel 110. For example, the active sealing systems 200 may only cover a fractional number (e.g., 10%, 50%, 85%) of the length between particular members of the frame 120 and/or panel 110. However, in certain aspects, the active sealing systems 200 provide substantially complete coverage between the sash 160 of a panel 110 and the frame 120. In so doing, the combined active sealing systems 200 can provide a seal substantially, completely around the panel 110.

Referring to FIGS. 2A-2C and 3A-3B, a combination of active sealing systems 200 is disclosed. In certain aspects of the door/window system 100, a plurality of identical or nearly identical active sealing system modules 200 are used to provide substantially complete coverage between the sash 160 of a panel 110 and the frame 120. In so doing, the same type of active sealing system module 200 is located on at least two sides of the frame/sash 120/160 (hereinafter referred to as the frame 120). In other aspects, more than one of the same type of active sealing system module 200 is located on a single side of the frame 120. Still further, in other aspects, at least one active sealing system module 200 of the same type is located on each side of the frame 120.

Although not limited in this manner, for those sides of the frame 120 that include multiple active sealing system modules 200, the multiple active sealing systems 200 may be each connected to a single anchor 210, which is used in forming the seal between the panel 110 and frame 120. The anchor 210 may be connected to movable members 225 of (see FIGS. 4A-4C) each of the multiple active sealing system modules 200, and via coordinated movement of movable members 225, the multiple active sealing system modules 200 cause the anchor 210 to move from a disengaged/unlocked position (e.g., FIG. 2A) to an engaged/locked position (e.g., FIG. 2C).

The multiple active sealing system modules 200 may also be interconnected such that upon one of the active sealing system modules 200 being engaged, additional active sealing system modules 200 engage. A transfer system 270 (described with regard to FIGS. 8A-8C and 9) may be used to transfer motion of a member in one of the active sealing system modules 200 to another member in a different one of the active sealing system modules, and in this manner, the engagement of one of the active sealing systems modules 200 can cause an additional active sealing system modules 200 to engage. Moreover, the active sealing system modules 200 may be connected in series such that the engagement of a single active sealing system module 200 can cause multiple active sealing system modules 200 to engage.

As noted above, each of the active sealing system modules 200 may be substantially identical. In so doing, a single type of module can be used on multiple or all sides of the door/window system 100. This may allow for ease of manufacturing since multiple types of modules increase the complexity of the manufacturing process. Moreover, the use of a single type of module may allow for easier and/or less-expensive repair of the door/window system since it may be easier and/or less-expensive to replace a single active sealing system module 200 as compared to a sealing system that spans a greater portion of the door/window system 100.

Although each of the active sealing system modules 200 may be substantially identical, depending upon the location of a particular active sealing system module 200 within the door/window system 100, modifications to the particular active sealing system 200 can be contemplated. For example, a corner member 295 (see FIGS. 4A-4C, 8A-8C, and 9) may be attached to an end of an anchor 210, and the corner member 295 can act to create a seal between a pair of adjacent anchors 210.

Additionally, the transfer system 270 may be removably attached to an end of a particular active sealing system module 200. For example, the transfer system 270 may be attached to pairs of adjacent active sealing system modules 200 in which motion of one member in one of the active sealing system modules 200 to another member in a different one of the active sealing system modules 200. This occurs, for example, at the corners of the door/window system 100. These additional features that can be added to a particular active sealing system module 200 add flexibility to the combined system of active sealing system modules 200.

Figure 3A:
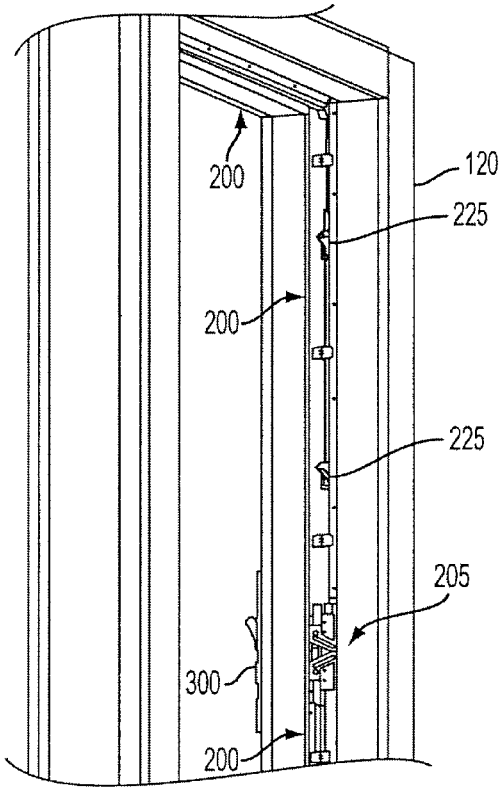
FIGS. 3A-3B are partial, perspective views of the multiple sealing system modules of FIGS. 2A-2C within a frame of the door/window system, respectively, without and with a facing covering the sealing system modules.
Figure 3B:
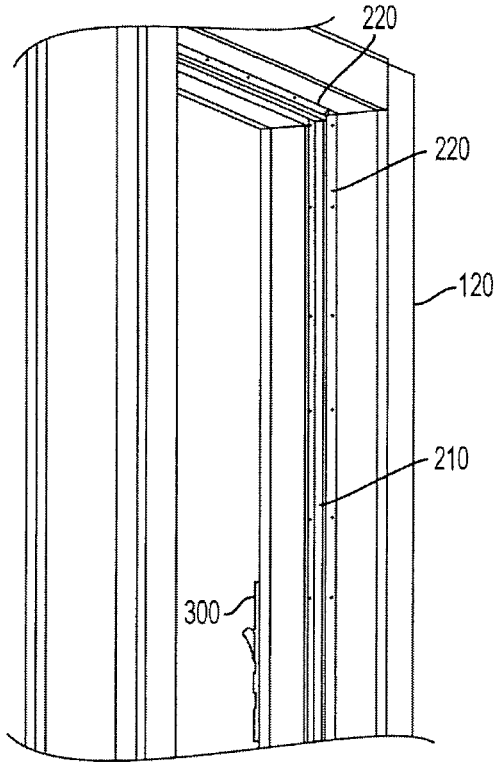
Figure 4A:
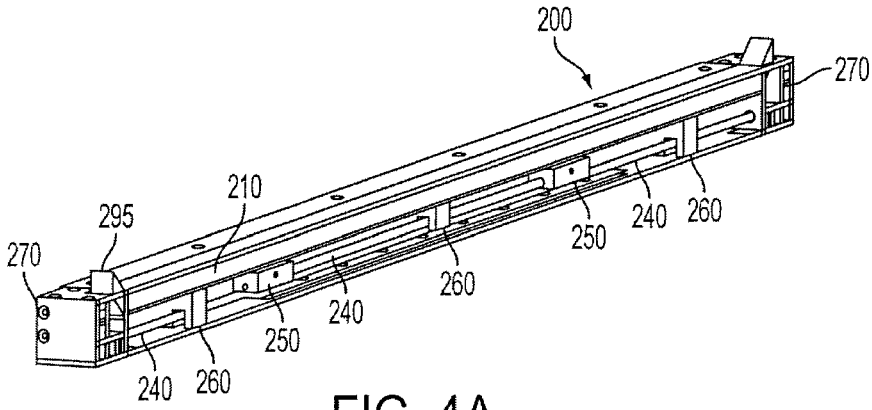
FIGS. 4A-4C are perspective views of an individual sealing system module in accordance with the inventive arrangements, respectively, in the unlocked, partially engaged, and locked configurations.
Figure 4B:
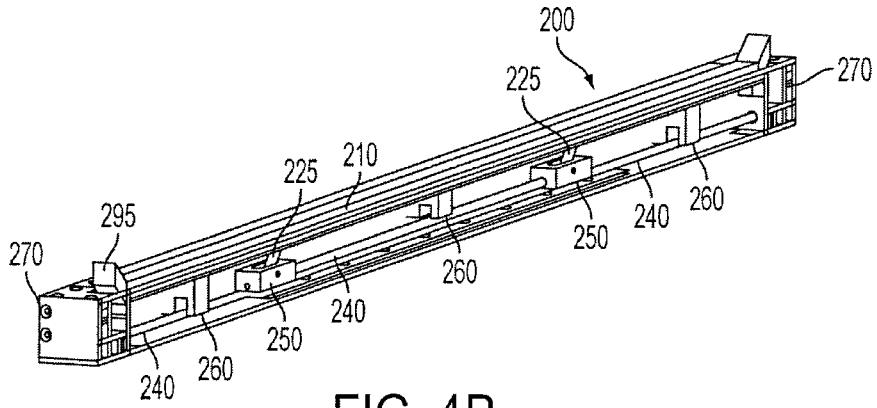
Figure 4C:
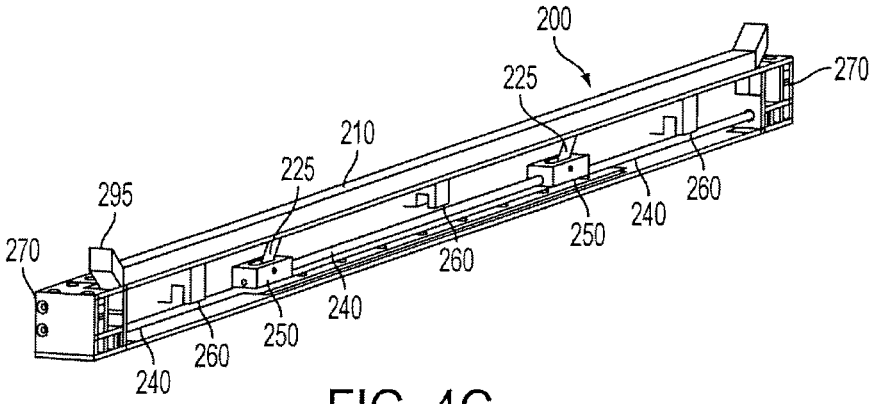
Figure 5A:
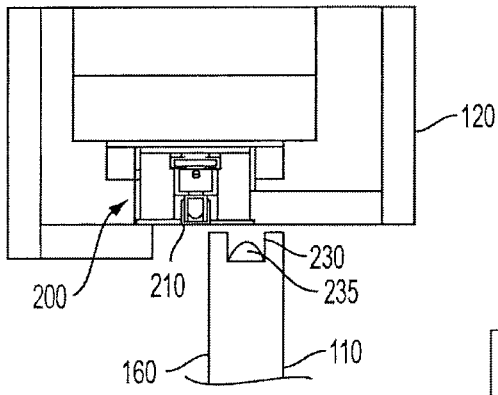
FIGS. 5A-5D are side views of a sealing system adjacent a panel in accordance with the inventive arrangements, respectively, in an open, closed and unlocked, partially engaged, and locked configurations.
Figure 5B:
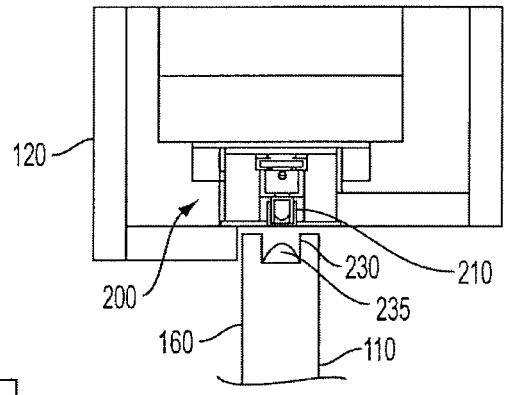
Figure 5C:
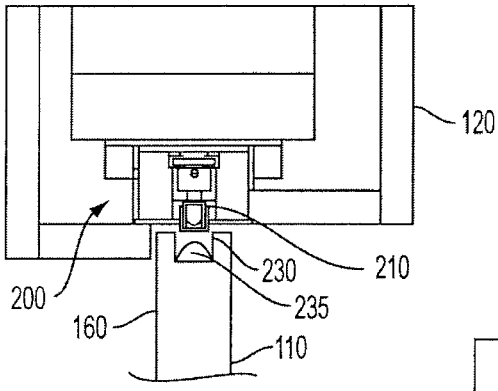
Figure 5D:
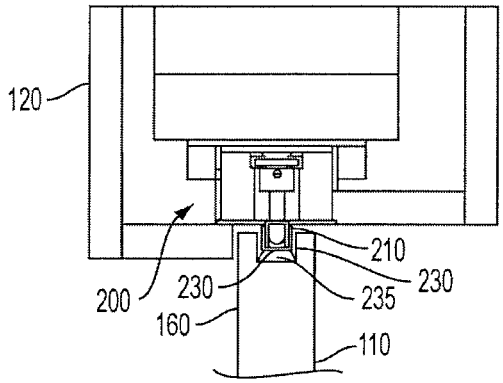

Referring to FIGS. 3A and 3B, facing 210 can be positioned over and removably attached to one or more of the individual active sealing system modules 200. In so doing, the use, on a single side, of multiple active sealing system modules 200 can be hidden. Moreover, the removably attachable facing 210 allows access to the active sealing system modules 200 for subsequent repairs, adjustment, and/or replacement of the active sealing system modules 200.

Referring to FIGS. 4A-4C and 5A-5D, an active sealing system 200 for use in the door/window system 100 is illustrated. In certain aspects of the active sealing system 200, the active sealing system 200 drives an anchor 210 to form a seal 230 (see FIG. 5D) between adjacent members of sash 160 and the frame 120. The seal 230 is formed by engagement of the anchor 210 positioned on one of the frame 120 and sash 160 with another feature positioned on the other of the frame 120 and sash 160. However, in certain aspects of the active sealing system 200, the anchor 210 is disposed in the frame 120 and engages a portion of the sash 160 of the panel 110. The active sealing system 200 may also include one or more transfer systems 270 that connect the active sealing system 200 to a seal activation system 205 (discussed within regard to FIGS. 6A-6C) and/or other active sealing systems 200 (see discussion with regard to FIGS. 8A-8C and 9).

The active sealing system 200 is not limited as to the particular portion of the sash 160 with which the anchor 210 engages to form the seal 230. However, in certain aspects of the active sealing system 200, the anchor 210 engages a portion of a channel 240 within members (e.g., header rail 175, stile rail 180, and sill rail 185) of the sash 160.

By having the anchor 210 being positioned within the channel 240, movement of the panel 110 relative to the frame 120 in a direction not parallel to the direction of the movement of the anchor 210 can be prevented. Moreover, in certain aspects, movement of the panel 110 relative to the frame 120 in a direction substantially perpendicular to the direction of movement of the anchor 210 can be prevented. In so doing, movement of the panel 110 relative to the frame 120 (via, for example, a forced entry) creates a force, against the anchor 210, having a minimal vector in the direction in which the anchor 210 moves. Thus, this forced movement of the panel 110 relative to the frame 120 has a reduced likelihood in forcing the anchor 210 to move, thereby increasing the security of the door/window system 100.

The anchor 210 may directly engage a portion of the channel 240. Alternatively, the anchor 210 may include a sealing member (not shown) that engages a portion of the channel 240 and/or engage a sealing member 235 within the channel 240. The sealing member retards the movement of air, water, etc. and/or noise across the seal, and any sealing member so capable is acceptable for use in the active sealing system 200. However, in certain aspects of the active sealing system 200, the sealing members 235 are formed from a compressible material, such as foam.

Many types of devices are known as being capable of moving the anchor 210 to engage the panel 110, and the active sealing system 200 is not limited as to a type of device so capable. However, in certain aspects of the active sealing system 200, the anchor 210 is attached to one or more movable members 225. The movable member 225 moves between a first position and a second position relative to the frame 120, and movement of the movable member 225 from the first position to the second position causes the anchor 210 to move from a disengaged/unlocked position (e.g., FIGS. 2A, 4A, 5A) to an engaged/locked position (e.g., FIGS. 2C, 4C, 5C).

The active sealing system 200 is not limited in the manner in which the movable member 225 is driven from the first position to the second position and back again. Many types of devices are known that are capable of transferring movement from one member to another member and the active sealing system 200 is not limited in a device so capable. However, in certain aspects of the active sealing system 200, the movement of the movable member 225 is driven by the back and forth motion of an actuator 240 that extends along a length of the active sealing system 200.

A transfer device 250 transfers the back and forth motion of the actuator 240 to the movable member 225 thereby moving the anchor from the disengaged/unlocked position to the engaged/locked position and back again. Many types of devices are capable of transferring motion along one direction to another direction, and the transfer device 250 is not limited to any type of device so capable.

The active sealing system 200 may also include supports 260 that are connected to the anchor 210. The supports 260 may be attached to an underside of the anchor 210 and positioned within the body of the active sealing system 200. The supports 260 span the inner width of the body of the active sealing system 200 and provide lateral stability to the anchor 210. The supports 260 may also act to limit the movement of the anchor 210 in one or multiple directions.

Figure 6A:
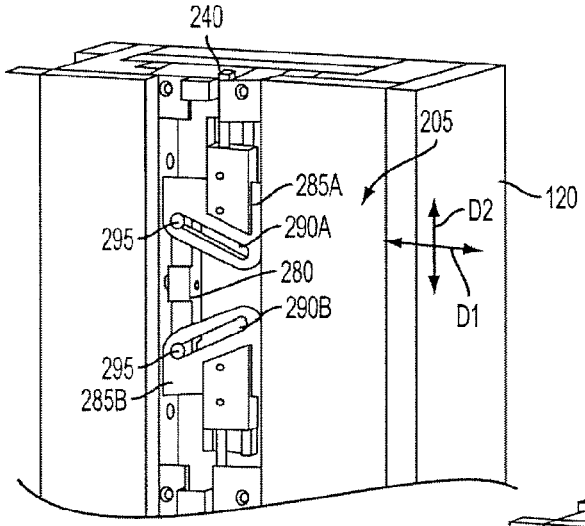
FIGS. 6A-6C are perspective views of a seal activation system in accordance with the inventive arrangements, respectively, in the unlocked, partially engaged, and locked configurations.
Figure 6B:
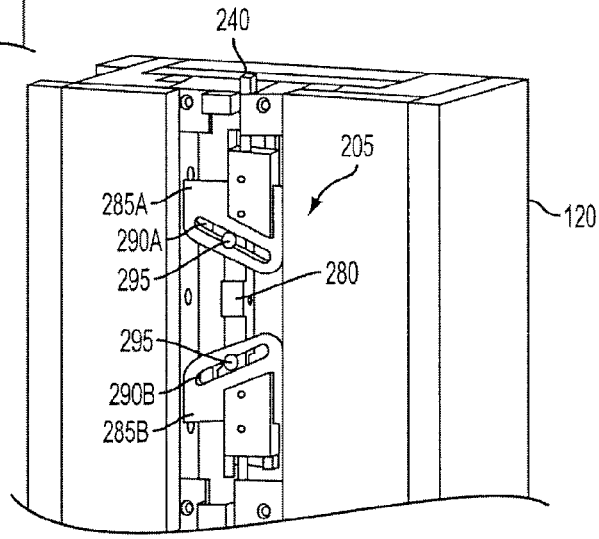
Figure 6C:
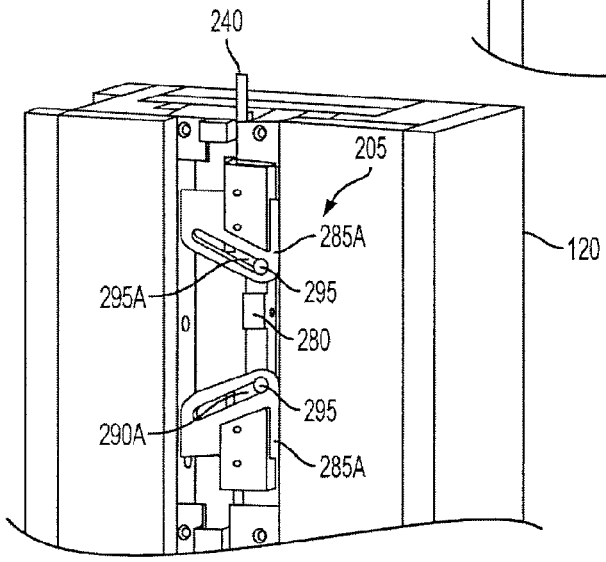

Referring to FIGS. 6A-6C, a seal activation system 205 for use in the door/window system 100 is illustrated. The seal activation systems 205 may be positioned within the header 130, jambs 140, and/or sill 150 of the frame 120. In certain aspects of the door/window system 100, the seal activation system 205 may interact with one or more active sealing systems 200 within the frame 120. These active sealing systems 200, in turn, may interact with the panel 110 to provide at least one seal 230 between adjacent members of the sash 160 of the panel 110 and the frame 120 in a locked configuration, and/or the active sealing system 200 may interact with the panel 110 to prevent the movement of the panel 110 relative to the frame 120 in the locked configuration. In an unlocked configuration, the active sealing system 200 may not provide the seal 230 and/or prevent movement of the panel 110 relative to the frame 120. Many types of seal activation system 205 capable of this type of interaction with an active sealing system 200 are known in the art, and the present door/window system 100 is not limited as to a particular type of seal activation system 205 so capable.

In certain aspects of the seal activation system 205, the seal activation system 205 transfers motion along a first axis D1 to motion along a second axis D2. Although not limited in this manner, the first axis D1 is substantially perpendicular to the second axis D2. Many types of devices are known that are capable of transferring motion from one member to another member and the door/window system 100 is not limited in a device so capable. However, in certain aspects of the seal activation system 205, the seal activation system includes a control member 280 that moves along the first axis D1, which is connected to a pair of opposing slides 285A, 285B that move along the second axis D2.

The control member 280 includes pins 295 that extend through slots 290A, 290B, respectively in each of the opposing slides 285A, 285B. The slots 290A, 290B are not parallel relative to the first and second axis D1, D2 such the distance between from one slot 290A to the other slot 290B varies along the length of the slots 290A, 290B. The pins 295 are at a fixed distance relative to one another such that movement of the control member 280 changes the distance between the opposing slides 285A, 285B. In the manner, movement of the control member 280 along the first axis D1 is translated into movement of the opposing slides 285A, 285B along the second axis D2.

Although the pins 295 are shown positioned within the control member 280 and the slots 290A, 290B are within the slides 285A, 285B, the seal activation system 205 is not limited in this manner. For example, the pins 295 can be located respectively in each of the slides 285A, 285B, and the slots 290A, 290B may be positioned within the control member 280.

The slides 285A, 285B, are connected to at least one actuator 240. However, in certain aspects of the seal activation system 205, the slides are each respectively connected to an actuator 240. The motion of the slides 285A, 285B along the second axis D2 is thus transferred to the actuators 240, and as previously discussed, the motion of the actuators 240 drive the movement of the anchors 210.

Figure 7:
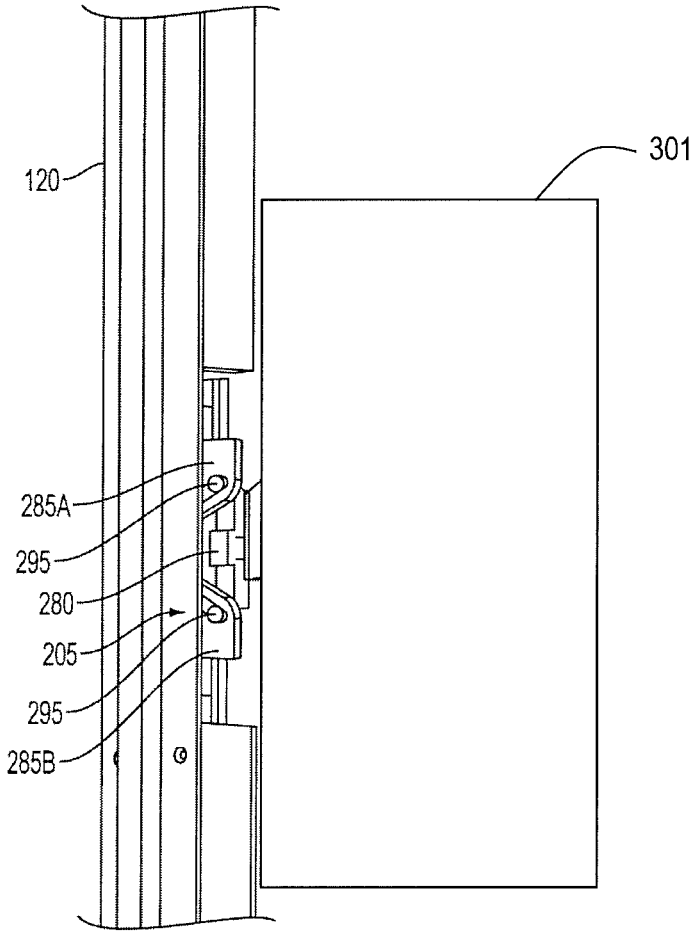
FIG. 7 is a perspective view of a drive portion of an electronic control system within a frame for driving the sealing activation system in accordance with the inventive arrangements.
Figure 8A:
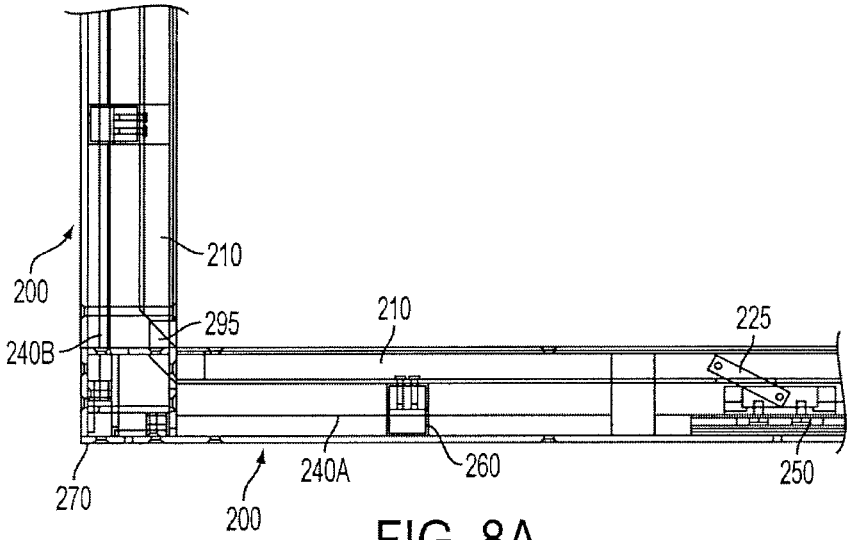
FIGS. 8A-8C are side views of adjacent sealing system modules in accordance with the inventive arrangements, respectively, in the unlocked, partially engaged, and locked configurations.
Figure 8B:
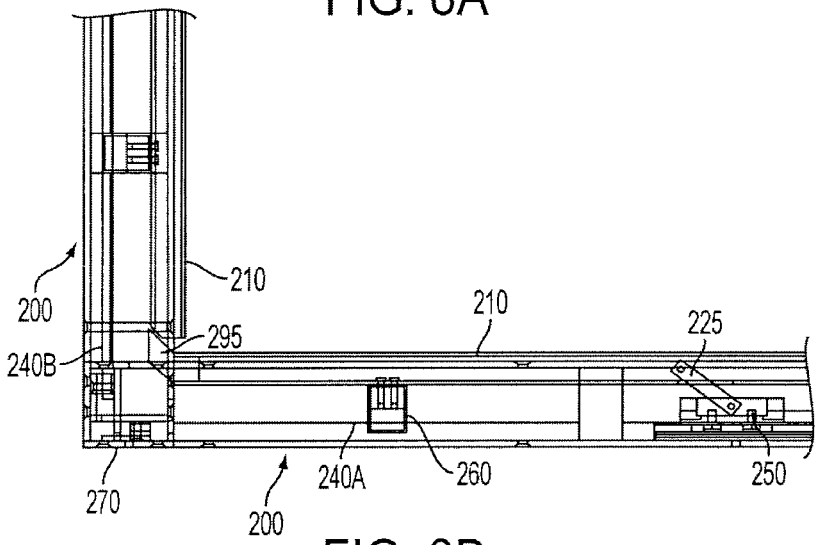
Figure 8C:
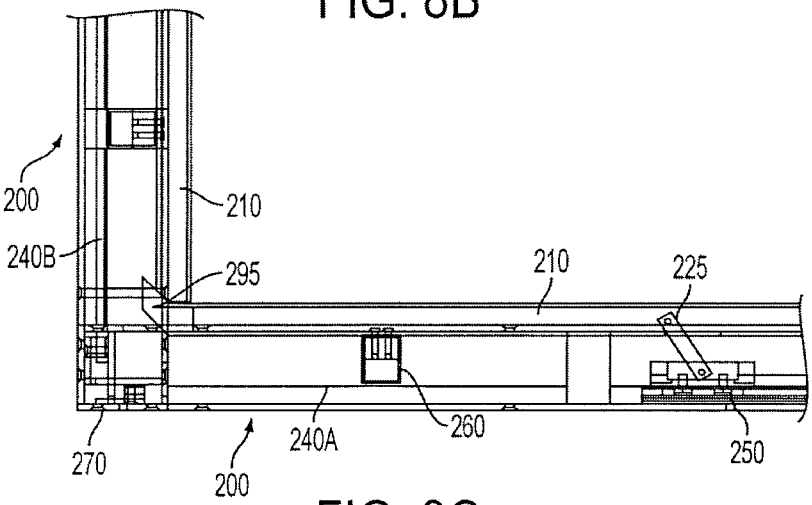
Figure 9:
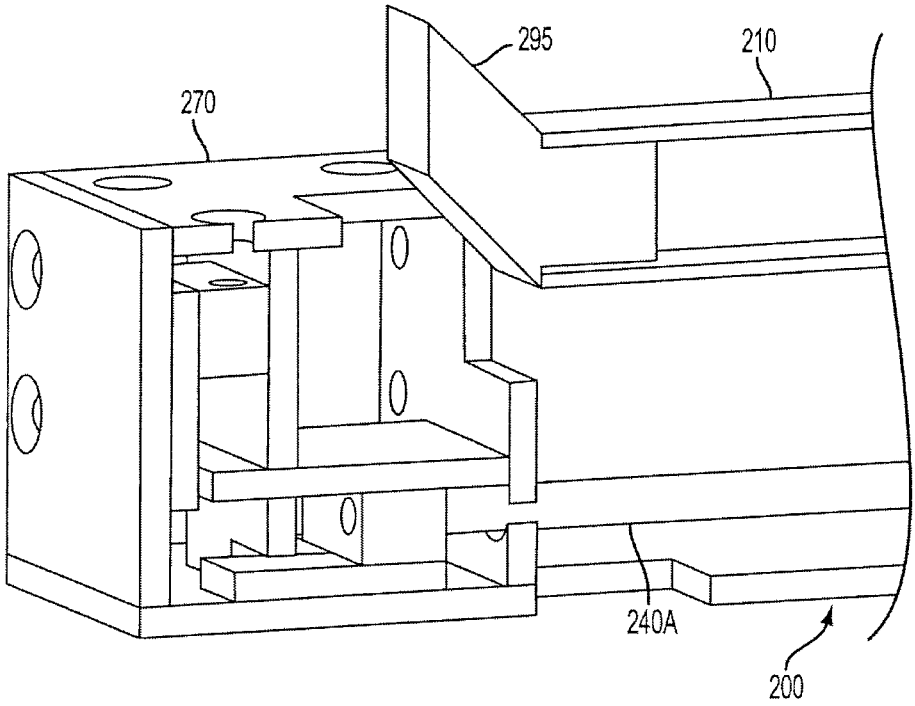
FIG. 9 is a perspective view of a transfer system and adjacent sealing system module in accordance with the inventive arrangements.

Referring to FIG. 7, a drive portion 301 of an electronic control system (see discussion with regard to FIGS. 10-13) for use in the door/window system 100 is illustrated. The drive portion 301 moves the seal activation system 205 from an deactivated/unlocked configuration (e.g., FIGS. 2A, 6A) to an activated/locked configuration (e.g., FIGS. 2C, 6C) thereby driving the active sealing system 200 from an deactivated/unlocked configuration to an activated/locked configuration. The drive portion 301 may also move the seal activation system 205 from the activated/locked configuration to the deactivated/unlocked configuration. In certain aspects, the drive portion 301 is configured to simultaneously drive each of the separate active sealing systems 200. In other aspects of the door/window system 100, however, multiple drive portions 301 may be provided to separately close one or multiple active sealing systems 200.

How the drive portion 301 moves the seal activation system 205 from the deactivated/unlocked configuration to the activated/locked configuration (and back again) is not limited as to a particular manner and/or device. As can be readily envisioned, the configuration and operation of the drive portion 301 may be determined by the configuration and operation of the seal activation system 205. A present example of the active sealing system 200 employs the use a locking actuator 335 (shown in FIG. 12) and an unlocking actuator 330 (shown in FIG. 12) that pushes/pulls on a connecting member 320 that is attached to the control member 280 of the seal activation system 205. This pushing/pulling motion creates the back and forth movement along axis D1 of the control member 280. The drive portion 301 is not limited in the manner in which the active sealing system 200 is driven. For example, devices employed for driving include magnetic, mechanical, pneumatic, and electro-mechanical devices.

Although not limited to this configuration, by positioning the active sealing systems 200, seal activation system 200, and the drive portion 301 all within the frame 120 of the door/window system 100, no moving parts need be positioned within the panel 100.

Referring to FIGS. 8A-8C and 9, a transfer system 270 for use in the door/window system 100 is illustrated. The transfer system 270 transfers motion, such as linear back and forth motion, from one actuator 240A to another actuator 240B. In so doing, the motion generated by a single seal activation system 205 is capable of driving two or more active sealing systems 200 located on different edges of the frame 120 and sash 160 through the use of one or more transfer systems 270. Alternatively or, in addition to a single seal activation system 205 driving two or more active sealing systems 200, as previously discussed, multiple seal activation systems 205 can each separately drive one or more active sealing systems 200.

Many types of transfer systems 270 are capable of transferring motion from one actuator 240A to another actuator 240B, and the door/window system 100 is not limited as to transfer system 290 so capable. For example, the transfer system 270 may include a set of inter-engaging gears respectively attached to the actuators 240A, 240B to transfer linear motion from one actuator 240A to the other actuator 240B. In certain aspects, however, the motion is transferred using a flexible strap (not shown) that is curved by a corner guide (not shown) within the transfer system 270 and respectively attached to both of the actuators 240A, 240B.

Figure 10:
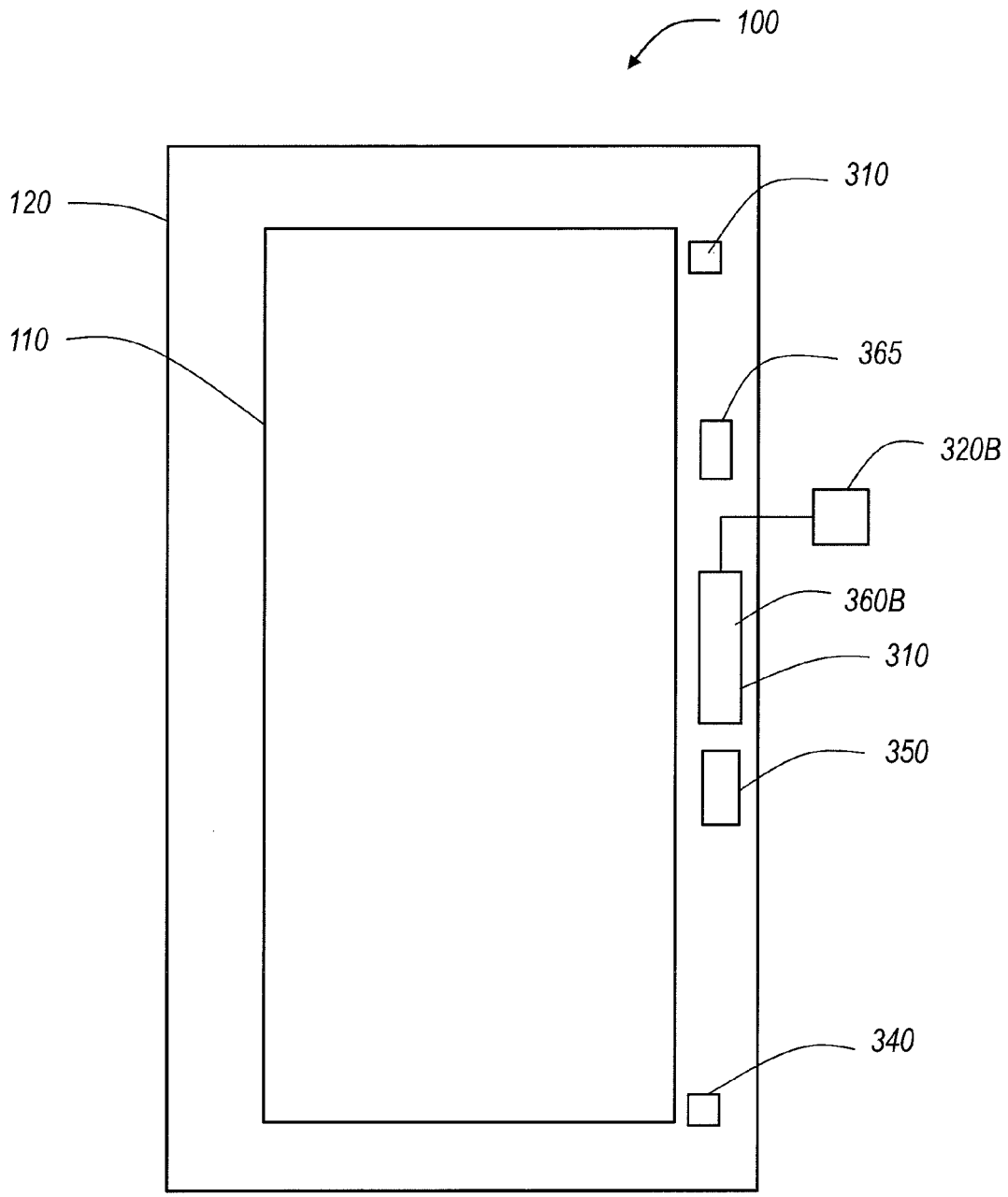
FIG. 10 is conceptual front view of the door/window system and certain elements of the electronic control system in accordance with the inventive arrangements.
Figure 11A:
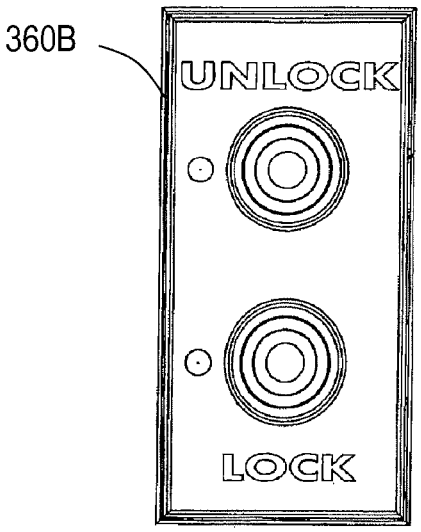
FIGS. 11A, 11B, 11C, and 11D are, respectively, front, side, rear, and perspective views of a control module and control device of the electronic control system in accordance with the inventive arrangements.
Figure 11B:
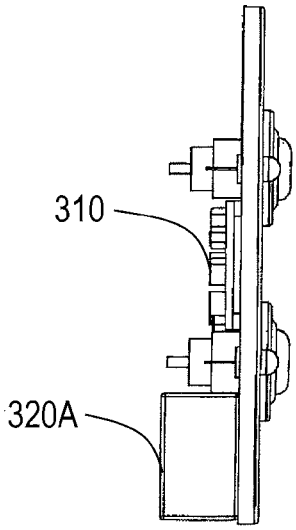
Figure 11C:
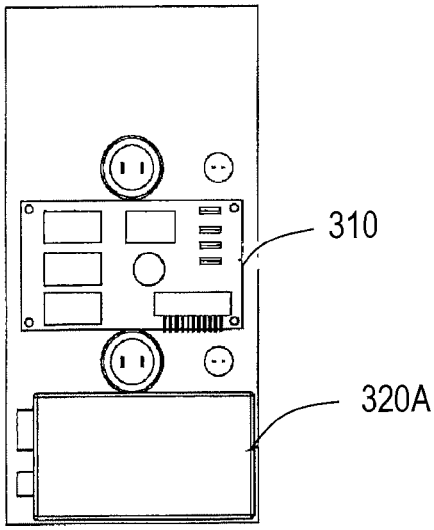
Figure 11D:
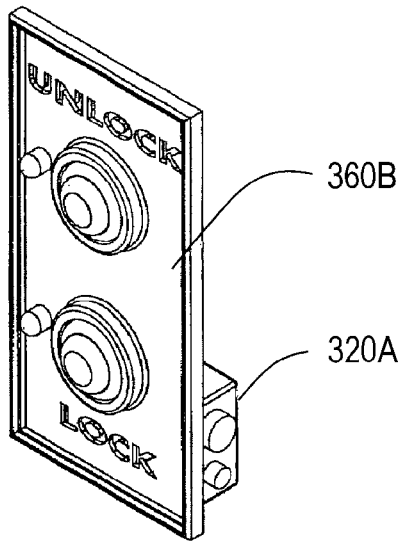
Figure 12:
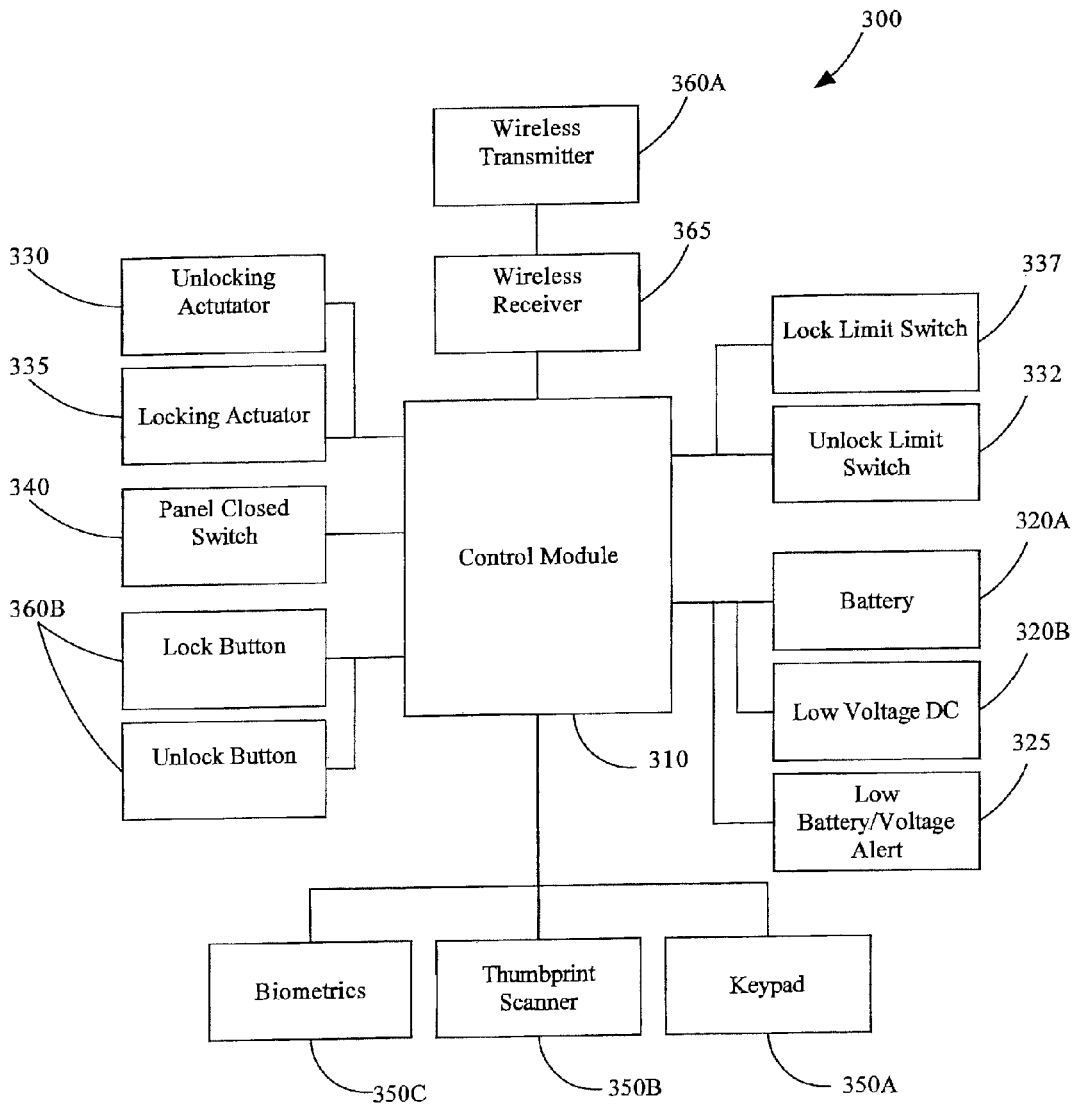
FIG. 12 is a schematic drawing of certain element of electronic control system in accordance with the inventive arrangements.

Referring FIGS. 10-12, the door/window system 100 includes an electronic control system 300 having one or more control modules 310 for causing the active sealing system 200 to become locked/unlocked. The control module 310 may include electronic logic control functions for operating the unlocking actuator 330 and locking actuator 335 in addition to providing other functions, as will be further described. Access to the electronic control system 300 may be secured via any type of conventional security devices 350. Examples of security devices 350 include a keypad (wireless or wired) 350A, a thumbprint scanner 350B, and a biometric scanner 350C. The security device 350 allows access to a lock/unlock control device 360 and/or allows modification of the control functions of the control module 310.

Examples of lock/unlock control devices 360 include both wireless control devices 360A and wired control devices 360B. The wireless control device 360A may include a fob having an IR transmitter, although the wireless control device 360A is not limited in this manner. Other types of transmitters, such as RF, may be included in the fob. The control board 310 is connected with (or includes) a receiver 365 for receiving signals from the transmitter. The transmitter may use code-hopping technology to reduce false activations and improve security. The receiver 365 may also include a programming switch to enable the receiver 365 to learn one or more additional transmitters.

An example of a wired control device 360B includes two momentary contact switches/buttons. The two contact switches/buttons may be labeled "Lock" and "Unlock" and respectively including red and green indicators, such as LEDs. The red LED can indicate when the active sealing system 200 is locked, and the green LED can indicate when the active sealing system 200 is unlocked.

Via, for example, the fob of the wireless control device 360A and/or the switches/buttons of the wired control device 360B, the control board 310 may be directed to control the seal activation system 205 to engage the active sealing system 200 to lock/unlock the panel 110 within the door/window system 110.

The electronic control system 300 may include an unlocking actuator 330 and a locking actuator 335. The locking actuator 335 acts to lock the panel 110 of the door/window system 100. The locking actuator 335 may be a linear actuator that provides voltage feedback to the control module 330. Although not limited to this particular configuration, upon the locking actuator 355 being activated, the locking actuator 335 can lock the panel 110 by extending the control member 280 (shown in FIG. 7) to a particular length, and the length may be determined by feedback from the locking actuator 335 to the control module 310. In addition to, or alternative to relying upon feedback from the locking actuator 335, a lock limit switch 337 may be positioned in such a manner, as is well-known in the art, to provide a signal to the control module 330 upon the active sealing system 200 being locked.

The unlocking actuator 330 acts to unlock the panel 110 of the door/window system 100. Although the unlocking actuator 330 may be separate from the locking actuator 335, in certain aspects of the electronic control system 300, the unlocking actuator 330 is combined with the locking actuator 335. Although not limited to this particular configuration, upon the unlocking actuator 330 being activated, the unlocking actuator 330 can unlock the panel 110 by retracting the control member 280 to a particular length, and the length may be determined by feedback from the unlocking actuator 330 to the control module 310. In addition to, or alternative to relying upon feedback from the unlocking actuator 330, an unlock limit switch 332 may be positioned in such a manner, as is well-known in the art, to provide a signal to the control module 330 upon the active sealing system 200 being unlocked.

The electronic control system 300 may include a panel closed limit switch 350. The panel closed limit switch 340 can be used to detect if the panel 110 is fully closed. The control module 310 may be configured to prevent the unlocking/locking actuators 330, 335 from operating unless the panel 110 is fully closed.

The electronic control system 300 may include a power supply 320 for powering the control module 310. The power supply 320 can also be used to power other devices, such as locks and motors in the door/window system 100 and/or the electronic control system 300. The electronic control system 300 is not limited as to a particular type of power supply 320. The power supply 320, for example, can be a battery-supplied power supply 320A, a low-voltage DC transformer power supply 320B, or a combination of both.

If the power supply 320A includes a battery, several different types/configurations of batteries are possible. A non-exhaustive list of configurations includes an option in which three non-rechargeable, primary lithium thionyl chloride battery (DD size, rated at 3.6V @35 Ah) are connected in series. Another option of the power supply 320A includes a Li-ion battery Pack (11.1V @2200 mAh) with an internal battery protection, which can limit the maximum discharge current to 6.5 A, the discharge voltage to 7.2V, and the charging voltage to 13V. In this option, the batter protection circuit accepts a dc voltage from an external power source and maintains the charge in the battery pack.

In yet another option, the power supply 320A includes a Li-ion battery Pack (11.1V @6600 mAh) with an internal battery protection that limits the maximum discharge current to 6.5 A, the discharge voltage to 7.2V, and the charging voltage to 13V. Two battery packs may be provided for each door/window system 100 along with a specific Li-ion battery pack charger. While one of the battery packs is inserted into the door/window system 100, the second battery pack can be charged and ready for use or in the process of being charged.

A battery monitoring circuit can be provided in the control module 310, and a low battery warning device 325 can be included in the electronic control system 300. The battery monitoring circuit can alert the user via a low battery warning device 325 (e.g., with an audible or visible alert) that the battery back in the door/window system 100 should be replaced with the freshly charged battery pack. The audible alert, for example, may be in the form of a short 20 millisecond burst followed by a 10 second period of silence.

Although not limited to this configuration, the external DC low voltage power supply 320B may include an AC-outlet mounted UL-approved, low voltage power supply. The power supply 320B may be the sole power supply or may be used in conjunction, for example, with a rechargeable battery power supply 320A. The power supply 320B may be located away from the installed door/window system 100 and hardwired to the control module 310 via standard 2-wire thermostat wiring. An inline fuse at the supply location can be used to provide short-circuit protection.

Figure 13:
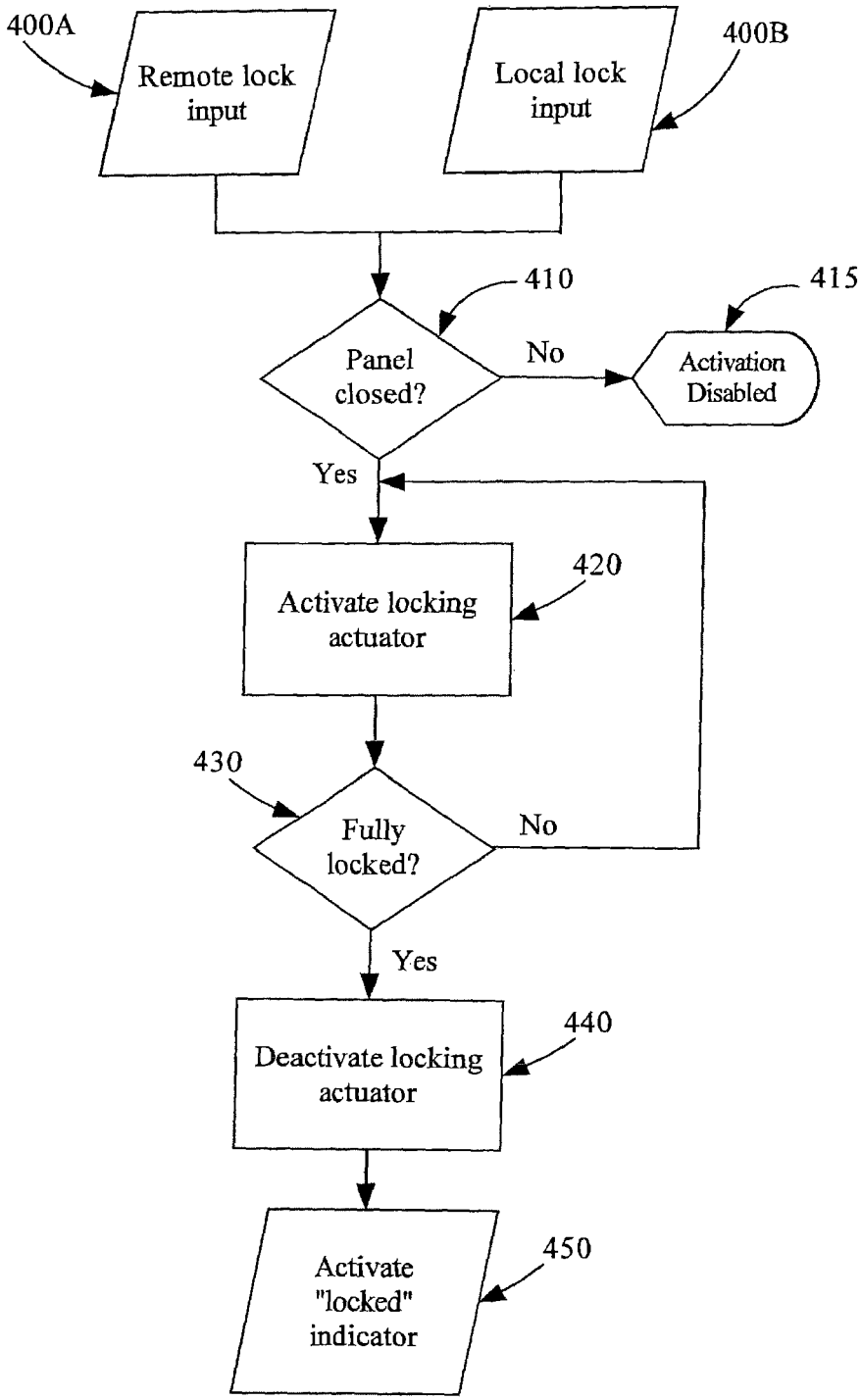
FIG. 13 is a flow chart illustrating certain steps involved in locking the panel in accordance with the inventive arrangements.

Referring to FIG. 13, an example of certain steps involved in the operation of the electronic control system 300 to lock the panel 110 of the door/window system 100 is illustrated. In either of steps 400A, 400B, a signal is received from either the wireless control device or the wired control device to lock the panel. In step 410, a determination is made as to whether or not the panel closed limit switch indicates that the panel is in a closed position. If the panel is not in the closed position, in step 415, activation of the locking system is disabled.

In step 420, if the panel is in the closed position, the control board activates the locking actuator and may deactivate the activation of the unlocking actuator. In step 430, a determination is made as to whether or not the active sealing system is fully locked. This determination may be made based upon feedback from the locking actuator and/or a signal from the lock limit switch that indicates that the active sealing system is locked. If the active sealing system is not fully locked, steps 420 and 430 are repeated. In step 440, upon the active sealing system being fully locked, the locking actuator is stopped/deactivated, and in step 450, an indicator, for example, a red LED associated with the lock button may be lit indicating that the panel is locked.

Figure 14:
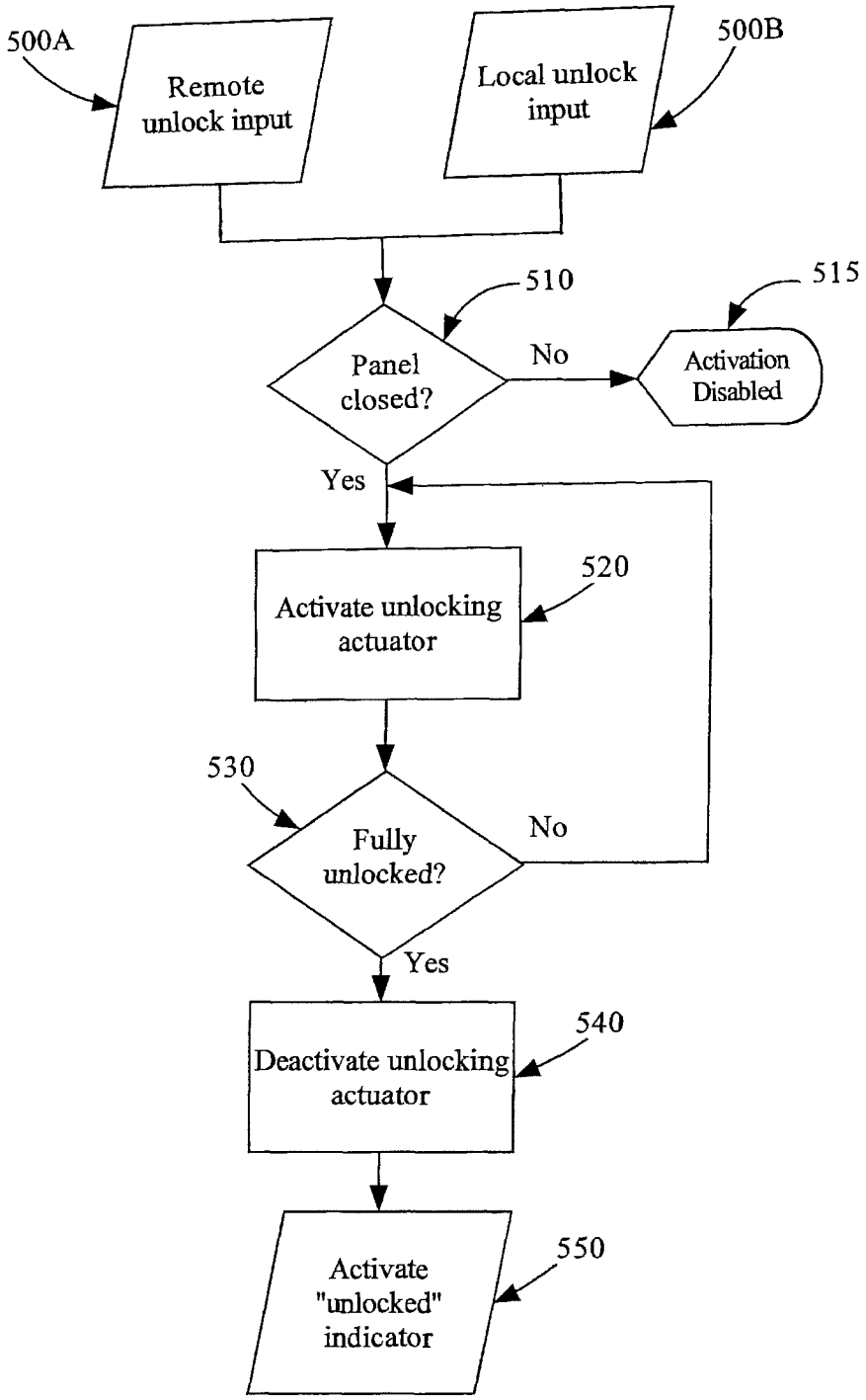
FIG. 14 is a flow chart illustrating certain steps involved in unlocking the panel in accordance with the inventive arrangements.

Referring to FIG. 14, an example of certain steps involved in the operation of the electronic control system 300 to unlock the panel 110 of the door/window system 100 is illustrated. In either of steps 500A, 500B, a signal is received from either the wireless control device or the wired control device to unlock the panel. In step 510, a determination is made as to whether or not the panel closed limit switch indicates that the panel is in a closed position. If the panel is not in the closed position, in step 515, activation of the locking system is disabled.

In step 520, if the panel is in the closed position, the control board activates the unlocking actuator and may deactivate the activation of the locking actuator. In step 530, a determination is made as to whether or not the active sealing system is fully unlocked. This determination may be made based upon feedback from the unlocking actuator and/or a signal from the unlock limit switch that indicates that the active sealing system is unlocked. If the active sealing system is not fully unlocked, steps 520 and 530 are repeated. In step 540, upon the active sealing system being fully unlocked, the unlocking actuator is stopped/deactivated, and in step 550, an indicator, for example, a green LED associated with the unlock button may be lit indicating that the panel is unlocked.

What is claimed is:

1. A system, comprising:

a frame;

a panel coupled to the frame;

a plurality of active sealing systems, each of the plurality of active sealing systems including:

an anchor for engaging one of the panel and the frame, and an actuator connected to the anchor and for driving the anchor, wherein in a closed position of the panel relative to the frame, the anchor is controllable to move from a locked position to an unlocked position and from the unlocked position to the locked position at least a portion of the active sealing system moves from the frame toward the panel in the locked position of the anchor;

a seal activation system connected to the actuator of the plurality of active sealing systems; and an electronic control system for controlling the seal activation system, wherein the electronic control system includes:

a control module, an unlocking actuator, and a locking actuator, wherein the control module controls activation of the unlocking actuator and the locking actuator.

2. The system of claim 1, further comprising a wireless control device wirelessly connected to the control module.

3. The system of claim 1, further comprising a wired control device having a wired connection to the control module.

4. The system of claim 3, further comprising a wireless control device wirelessly connected to the control module.

5. The system of claim 1, further comprising a battery for supplying power to the electronic control system.

6. The system of claim 5, wherein the battery is positioned within the frame.

7. The system of claim 5, further comprising a low-battery indicator.

8. The system of claim 1, further comprising a power supply electrically connected to a building in which the frame is installed.

9. The system of claim 8, further comprising a battery for supplying power to the electronic control system.

10. The system of claim 9, wherein the power supply is adapted to recharge the battery.

11. The system of claim 10, further comprising a security device for controlling access by a user to the control module.

12. The system of claim 1, wherein the unlocking actuator is the locking actuator.

13. The system of claim 12, wherein the locking actuator is connected to the seal activation system.

14. The system of claim 1, further comprising a panel closed limit switch for determining if the panel is fully closed.

15. The system of claim 1, further comprising a lock limit switch and an unlock limit switch.

* * * * *